US010774577B2

(12) United States Patent
Staton et al.

(10) Patent No.: US 10,774,577 B2
(45) **Date of Patent: *Sep. 15, 2020**

(54) WINDOW SYSTEM WITH INSERT FOR PREVENTING GLASS BREAKAGE

(71) Applicant: Newtonoid Technologies, L.L.C., Liberty, MO (US)

(72) Inventors: Fielding B. Staton, Liberty, MO (US); David Strumpf, Columbia, MO (US)

(73) Assignee: NEWTONOID TECHNOLOGIES, L.L.C., Liberty, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/793,812

(22) Filed: Feb. 18, 2020

(65) Prior Publication Data

US 2020/0181972 A1 Jun. 11, 2020

Related U.S. Application Data

(62) Division of application No. 16/318,997, filed as application No. PCT/US2017/042815 on Jul. 19, 2017, now Pat. No. 10,563,452.

(Continued)

(51) Int. Cl.
*E06B 3/00* (2006.01)
*E06B 3/67* (2006.01)

(Continued)

(52) U.S. Cl.
CPC ..... *E06B 3/6707* (2013.01); *E06B 5/12* (2013.01); *E06B 3/66* (2013.01)

(58) Field of Classification Search
CPC ..... E06B 3/56; E06B 3/5454; E06B 3/26303; E06B 2003/26389; E06B 3/66366;

(Continued)

(56) References Cited

U.S. PATENT DOCUMENTS 2,684,266 A * 7/1954 Englehart ..... E06B 3/66314 52/172
3,527,663 A 9/1970 Rose et al.

(Continued)

FOREIGN PATENT DOCUMENTS

GB 1549875 A 8/1979
KR 20100133526 A 12/2010
WO 20080050028 A2 2/2008

OTHER PUBLICATIONS

PCT Application No. PCT/US2017/042815, International Preliminary Report on Patentability, dated Jan. 31, 2019.

(Continued)

*Primary Examiner* — Chi Q Nguyen
(74) *Attorney, Agent, or Firm* — Avant Law Group, LLC

(57) ABSTRACT

A window system for dissipating impact forces happening upon a window includes first and second window panes spatially separated and surround by a window frame; and tubing positioned between the first and second window panes around a perimeter of the window. A waveform energy having a fundamental frequency is received by one of the first and second window panes and is partially transferred to the tubing. The tubing attenuates the impact of the energy on the window.

20 Claims, 10 Drawing Sheets

Related U.S. Application Data

(60) Provisional application No. 62/405,501, filed on Oct. 7, 2016, provisional application No. 62/364,129, filed on Jul. 19, 2016.

(51) Int. Cl.
*E06B 5/12* (2006.01)
*E06B 3/66* (2006.01)

(58) Field of Classification Search
CPC .... E06B 3/6638; E06B 3/66342; E06B 3/677; E06B 3/66361; E06B 3/66304; E06B 3/663; E06B 3/66314
USPC ..... 52/204.595, 204.593, 172, 204.591, 52/786.13, 786.1, 786.11; 156/107, 109, 156/106
See application file for complete search history.

(56) References Cited

U.S. PATENT DOCUMENTS 4,074,480 A * 2/1978 Burton ..... E06B 3/5418 428/34
4,114,342 A * 9/1978 Okawa ..... E06B 3/6707 181/284
4,649,685 A 3/1987 Wolf et al.
4,669,241 A 6/1987 Kelly
4,720,950 A 1/1988 Bayer et al.
5,088,258 A 2/1992 Schield et al.
5,313,761 A * 5/1994 Leopold ..... E06B 3/6675 52/456
6,668,974 B1 12/2003 Mottelet et al.
6,916,392 B2 * 7/2005 Trpkovski ..... B23B 49/005 141/59
8,316,596 B2 * 11/2012 Anderson ..... E06B 3/677 52/204.62
10,132,114 B2 * 11/2018 Siodla ..... E06B 3/66319
10,563,452 B2 * 2/2020 Staton ..... E06B 3/6707
2001/0001357 A1 * 5/2001 Reichert ..... E06B 3/66319 52/786.13
2011/0220099 A1 9/2011 Flaherty
2012/0017524 A1 * 1/2012 Milburn ..... F26B 3/28 52/172
2014/0352239 A1 12/2014 Cho
2015/0330138 A1 11/2015 Staton

OTHER PUBLICATIONS

Extended European Search Report received in European Application No. 17831772.3 dated Nov. 21, 2019.

* cited by examiner

WINDOW SYSTEM WITH INSERT FOR PREVENTING GLASS BREAKAGE

CROSS-REFERENCE TO RELATED APPLICATIONS

This application is a divisional of U.S. patent application Ser. No. 16/318,997, filed Jan. 18, 2019, now U.S. Pat. No. 10,563,452, which is the national phase of, and claims priority to, International Patent Application No. PCT/US2017/042815, filed Jul. 19, 2017, which designated the U.S. and which claims priority to U.S. Provisional Patent Application No. 62/364,129, filed Jul. 19, 2016, and U.S. Provisional Patent Application No. 62/405,501, filed Oct. 7, 2016. The applications are each incorporated by reference herein in their entireties.

BACKGROUND

All windows, regardless of whether they are single pane, double pane, made of pure glass, or acrylic are subject to breakage due to forces that are received upon one or more of the panes of windows. A breakage occurs when a force that is received by the window pane is greater than that which the window pane was designed to withstand. Acrylic glass windows, such as Plexiglas®, Acrylite®, Lucite®, and Perspex®, were designed using poly(methyl 2-methylpropenoate), which gives the window increased resiliency and ability to resist breakage. Unfortunately, however, cracks and breaks still occur and require repair, or in some cases, total replacement.

An additional flaw of many windows is their inability to dampen outside noise. A windows' ability to block out or reduce noise is quantified according to a Sound Transmission Class (STC). STC ratings measure the average amount of noise stopped at 18 different frequencies, in decibels. The higher the STC value, the more sound is stopped. The STC rating for an average double-pane window is usually in the range of about 26 to 33. By comparison, a single pane glass window has an STC rating of about 26-28. Even the best dual pane windows, which may have an STC rating of 35, still allow a significant amount of noise to transfer through to the other side.

A simple but effective system for reducing a window's susceptibility to breakage and increasing noise blockage would be desirable.

SUMMARY

The following presents a simplified summary of the invention in order to provide a basic understanding of some aspects thereof. The summary is not an extensive overview of the invention. It is not intended to identify critical elements of the invention or to delineate the scope of the invention. Its sole purpose is to present some concepts of the invention in a simplified form as a prelude to the more detailed description that is presented elsewhere herein.

In one embodiment, a window system for dissipating impact forces happening upon a window includes first and second window panes separated by a spacer and tubing positioned between the first and second window panes substantially adjacent the spacer. The tubing includes at least one tab extending outwardly from the tubing. In a use configuration, the tab extends partially along a width of the spacer and is positioned between the spacer and one of the first and second window panes. The spacer is coated with an adhesive, which causes a seal to be formed between the first and second window panes around the tab. In use, an initial force happens upon one of the first and second window panes and is at least partially shifted to the tubing causing the tubing to temporarily deform. The tubing subsequently returns to its initial shape.

In another embodiment, a window system for dissipating impact forces happening upon a window includes first and second window panes separated by a spacer and tubing positioned between the first and second window panes substantially adjacent the spacer. The spacer is coated with an adhesive, the adhesive causing a seal to be formed between the first and second window panes. In use, a waveform energy having a fundamental frequency is received by one of the first and second window panes and is partially transferred to the tubing. The tubing attenuates the impact of the energy on the window.

In still another embodiment, a window system for dissipating impact forces happening upon a window includes first and second window panes spatially separated and surround by a window frame; and tubing positioned between the first and second window panes around a perimeter of the window. A waveform energy having a fundamental frequency is received by one of the first and second window panes and is partially transferred to the tubing. The tubing attenuates the impact of the energy on the window.

DETAILED DESCRIPTION OF THE DRAWINGS

Figure 1:
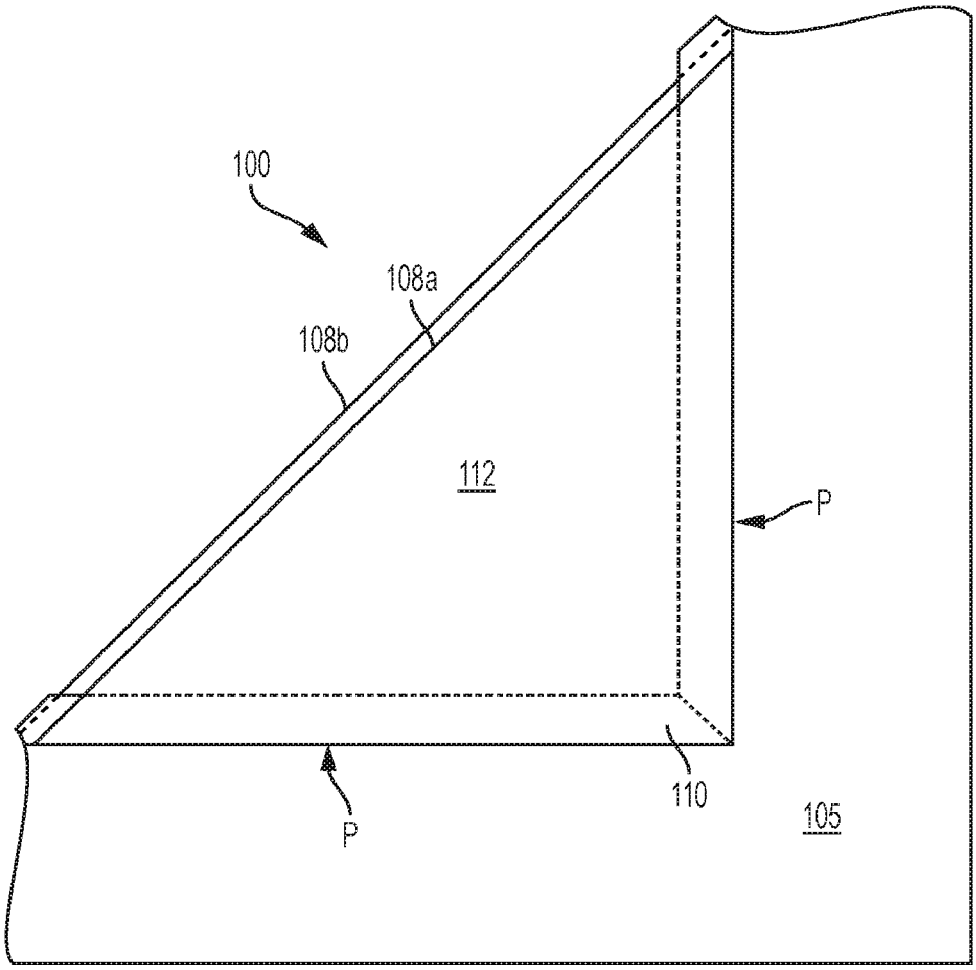
FIG. 1 is a perspective front view of a section of a window having tubing disposed therein according to one embodiment of the invention.
Figure 2:
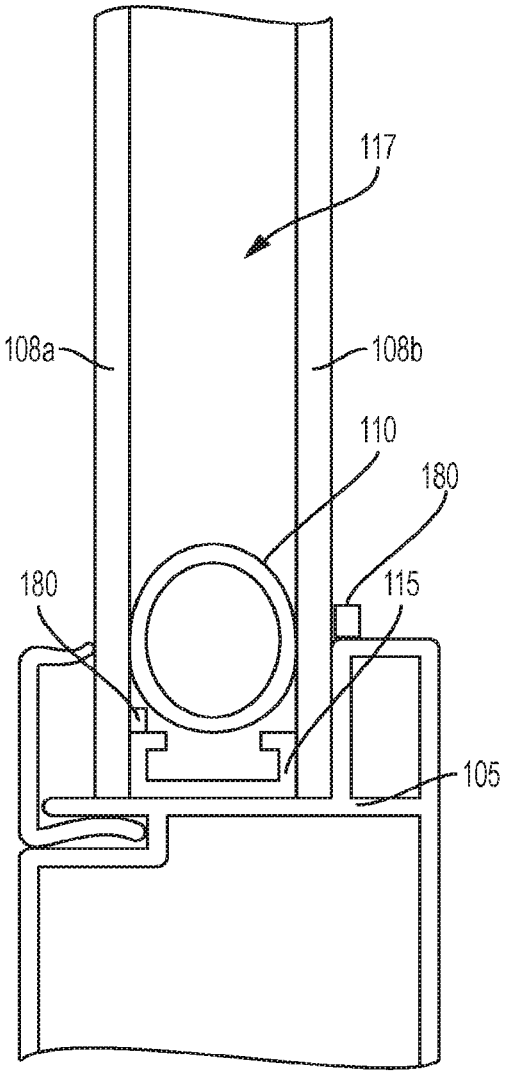
FIG. 2 is a side view of a section of a window according to the embodiment of FIG. 1.

Window systems for preventing damage to the window and reducing noise transmissions are disclosed herein. FIGS. 1-2 illustrate a cut-out portion of a double-pane window 100 having a sash 105 supporting first and second window panes,

108*a* and 108*b* respectively. A spacer 115 coated with an adhesive (e.g, butyl) is positioned around the perimeter P of the window between the first and second window panes 108*a* and 108*b*. The spacer 115 ensures that the panes 108*a* and 108*b* are kept a uniform distance apart. Additionally, the spacer 115 can help to insulate the window. Less metal spacers and no metal spacers incorporate foam to reduce heat transfer through the window and avoid condensation buildup. In the void 117 between the window panes 108*a* and 108*b*, window manufacturers will often inject gas to act as further insulation.

Thus, while there are incorporated within a window insulating systems, windows do not have systems for preventing glass breakage and/or systems for reducing sound transmission. In an embodiment of the invention, tubing 110 is positioned around the perimeter P of the window 100 between the window panes 108*a* and 108*b* to provide breakage protection and noise reduction. The tubing 110 may abut the spacer 115. Depending on the size (diameter) of the tubing, a portion of the tubing 110 may extend into the main portion 112 of the window 100. By extending into the main portion 112 of the window 100, the tubing 110 may be better able to diffuse the forces received by the main portion 112 of the window. The tubing 110 may thus be visible through the window 100, and therefore, it may be desirable for the tubing 110 to be substantially transparent. In a preferred embodiment, the tubing 110 is configured as a clear material such that the tubing 110 is as inconspicuous as possible.

Figure 3A:
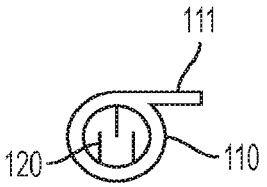
FIG. 3A is a front view of a piece of tubing according to one embodiment of the invention.
Figure 3B:
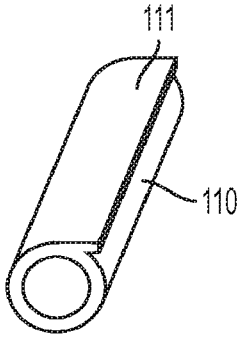
FIG. 3B is a perspective view of a piece of tubing according to another embodiment of the invention.
Figure 3C:
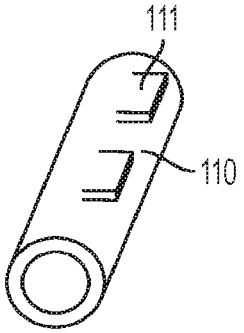
FIG. 3C is a perspective view of a piece of tubing according to still another embodiment of the invention.

In one embodiment, the tubing 110 may be a simple cylindrical tube, as shown in FIG. 2. In other embodiments, the tube 110 may take a variety of alternate configurations. FIGS. 3A-3H illustrate several possible configurations of the tubing. FIG. 3A shows the tubing 110 having one or more tabs 111. FIG. 3B shows the tubing 111 with a single tab 111 running along the length of the tubing 110. Alternately, FIG. 3C shows a plurality of tabs 111 disposed along the length of the tubing. FIGS. 3A-3C show the tab(s) 111 extending outwardly from the tubing 110 such that the tab 111 is tangential to a point along the outer perimeter of the tubing 110. Those of ordinary skill in the art shall recognize that the tabs 111 may be co-molded, co-extruded, or extruded with the tubing 110 as a single unitary piece. Alternately, the tabs 111 may be manufactured separately from and subsequently adhered to the tubing 110.

Figure 3D:
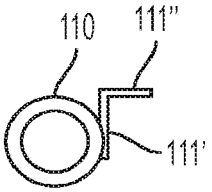
FIG. 3D is a front view of a piece of tubing according to still yet another embodiment of the invention.
Figure 3E:
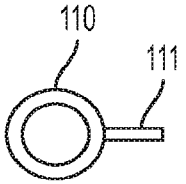
FIG. 3E is a front view of a piece of tubing according to another embodiment of the invention.

In still other embodiments, as shown in FIG. 3D, the tab 111 includes a side portion 111' and a top portion 111" extending perpendicularly from the side portion 111'. The side portion 111' may preferably be co-molded with the tubing 110 or may be otherwise attached to the tubing 110 as appropriate. In a further embodiment, illustrated in FIG. 3F, the tubing 110 is provided in a "U" shape, rather than a cylindrical shape.

Figure 4:
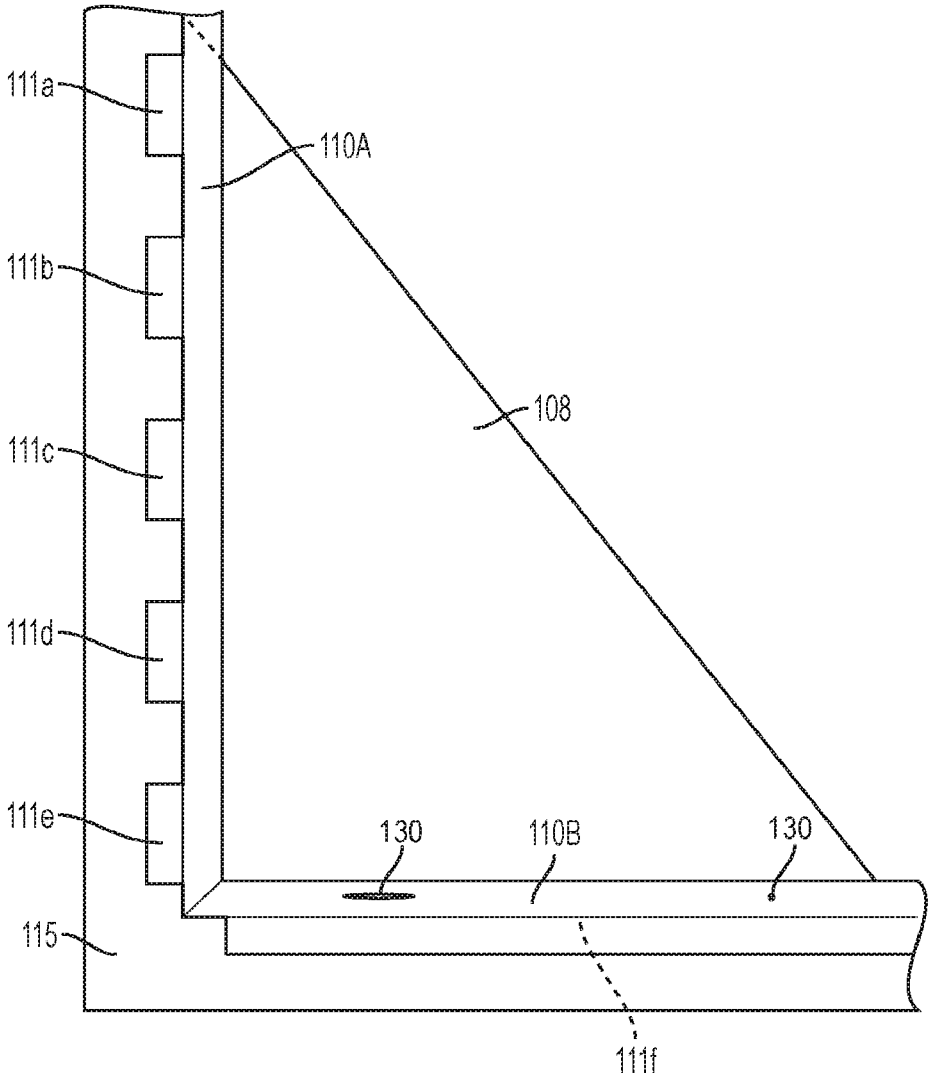
FIG. 4 is a front view of a section of a window having tubing disposed therein according to another embodiment of the invention.

The tabs 111 may be useful, among other things, to ensure that the tubing 110 does not move from its intended position. The tab 111 may extend away from the tubing 110 a sufficient distance such that, when placed along the spacer 115, it extends toward the center of the spacer. FIG. 4 illustrates tubing 110A having a plurality of tabs (e.g., 111*a*, 111*b*, 111*c*, 111*d*, 111*e*, etc.) which extend into and along the width of the spacer 115. Also illustrated is tubing 110B having a single tab 111*f* which runs along the length of the spacer 115.

Figure 3F:
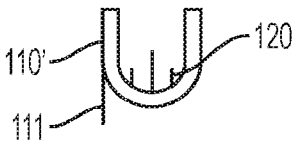
FIG. 3F is a front view of still another piece of tubing according to still another embodiment of the invention.

FIGS. 3A and 3F show tubing 110 having filaments 120 disposed within the center portion of the tubing 110. The filaments 120 may be provided in addition to the tabs 111, or in a simple cylindrical tubing 110 without tabs 111. The filaments 120 may be formed from a flexible material that moves (e.g., resonates) as a result of forces that happen upon one or more of the window panes 108. Forces may include physical forces to the window (e.g., a rock hitting the window) but may also be forces that are much smaller in magnitude, such as sound waves, radio waves, seismic waves, etc.

The filaments 120 may be particularly useful to prevent sound from transmitting through the window 100. The filaments 120 may be provided in varying lengths to stifle varying frequencies of sound waves. The filaments 120 may be co-molded, co-extruded, or extruded with the tubing 110, as is known to those of skill in the art.

Figure 3G:
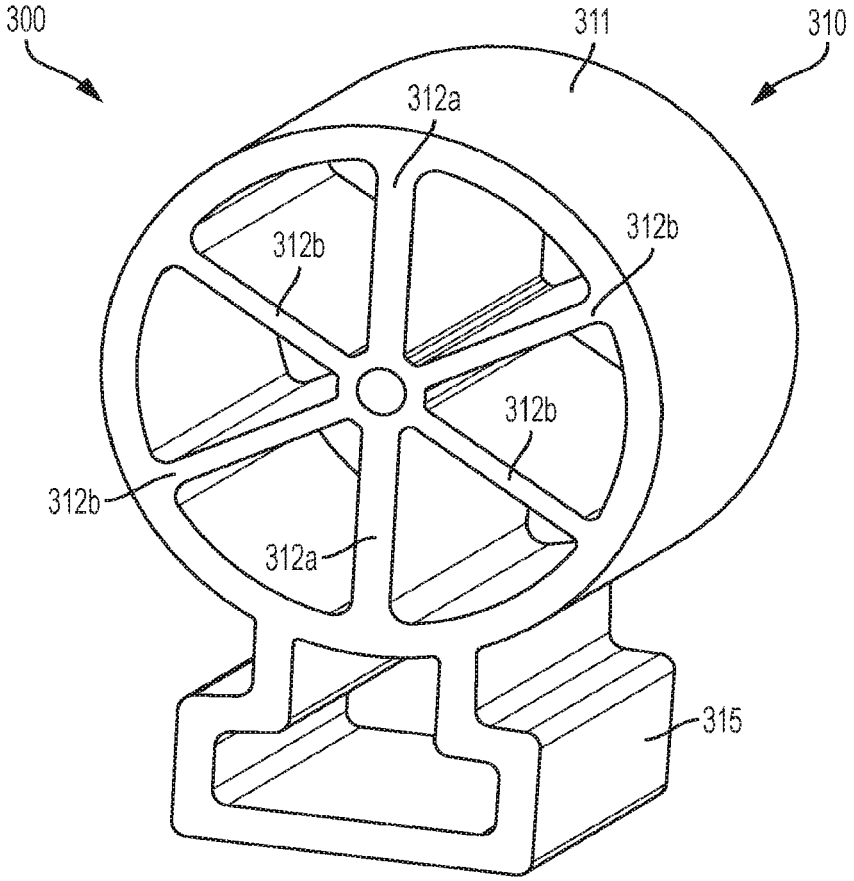
FIG. 3G is a perspective view of a piece of tubing according to still yet another embodiment of the invention.
Figure 3H:
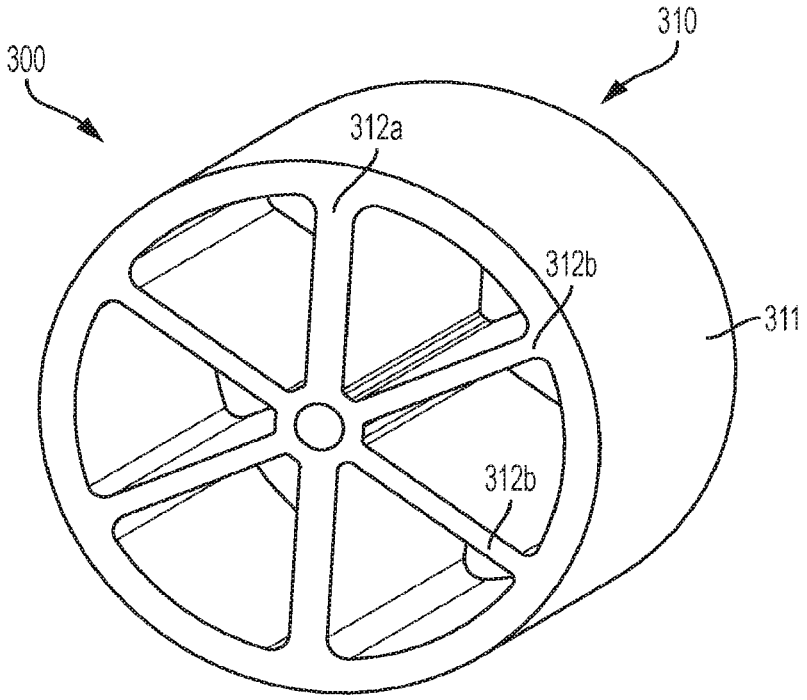
FIG. 3H is a perspective view of a piece of tubing according to a further embodiment of the invention.

FIGS. 3H and 3G illustrate additional alternative embodiments of a window system 300 having tubing 310 with splines 312 extending through the center thereof. A central spline 312*a* extends transversely across the tube 310, and at least one, and preferably more than one, additional spline 312*b* extends diagonally across the tube 310. The outer wall 311 of the tubing 310 (and/or tubing 110) may be formed of any flexible plastic, and may have a durometer of 0 to 80 on the Shore A durometer scale. The splines 312 may additional be formed of any plastic material having a durometer of 0 to 80 on the Shore A scale. Preferably, the splines 312 may have a lower durometer than that of the outer wall 311. Further, the central spline 312*a* may have a higher durometer than the diagonal splines 312*b*.

Those of ordinary skill in the art shall understand that the varying levels of hardness of the outer wall 311 and splines 312 may allow the tubing 310 the flexibility to prevent breakage of the window due to impact forces, but also to decrease the amount of sound waves (or other energy waves) that can pass through the window 100. For example, the central spline 312*a* may block different frequencies of waves than then splines 312*b* due to the difference in the hardness of material of the splines 312. Nevertheless, it shall be understood that the splines 312 are flexible such that the tubing 310 is compressible.

Optionally, as shown in FIG. 3G, the tubing 310 may further include a pedestal 315. The pedestal 315 may be formed from the same or similar material as the tubing outer wall 311 or the splines 312. The pedestal 315 may be configured to slide into and fit within the spacer of a window in order to hold the tubing 310 in place. In one embodiment, the tubing 310 may optionally be configured with tabs as described above. Preferably, the tubing 310 is provided along the entire perimeter P of the window.

The tubing 110, 310 may be selected from any visco-elastic material that is capable of reducing the forces received by a window pane as a result of an impact, such as urethane polymers, rubber, silicone, cyclic olefin copolymers, polyurethanes, polyethylene, polypropylene, polystyrene, polyvinyl chloride, polyamides, polyethylene terephthalate, polycarbonates, et cetera. Additional materials which may be utilized include sound absorbing materials, including but not limited to traditional foam, foamed elastomers, open celled polyurethane foams, composites, et cetera. In one embodiment, the tubing 110 is made of Sorbothane®. In another embodiment, the tubing 110 is manufactured from polynorbornene, Noene, or Astro-sorb. As noted above, it may be desirable for the tubing 110 to be substantially transparent so as to not to obstruct the view into or out of the window.

In one embodiment, it may be desirable for sound to be allowed to travel partially through the tubing. In order to avoid further impediment to the sound waves, the tubing 110, 310 may have a plurality of apertures 130 formed therein, through which sound waves are allowed to travel. The apertures 130 may take the form of slits or holes (FIG. 4). The apertures 130 may have a small profile, allowing some of the waves to penetrate the tubing 110 through the apertures 130. A portion of the sound waves may be trapped in the tubing 110; thereby reducing the amount of sound that travels through the window.

The tubing 110, 310 may be supplied on a roll for easy placement along the perimeter P of the window 100. In this way, several benefits may be recognized, including reduced factory footprint, increased efficiency due to ease of use and placement, and little waste. The tubing 110 may be placed within the window panes 108*a* and 108*b*, generally according to the methods of constructing double pane window. Typically, double pane windows are constructed by first placing a first window pane (e.g., 108*a*) on a preparation surface. A spacer 115 coated with an adhesive (e.g., butyl) is laid around the perimeter P of the first window pane 108*a*. The second window pane (e.g., 108*b*) is then aligned with the first window pane 108*a* and placed atop the adhesive to seal the two panes 108*a* and 108*b* together. Here, once the spacer 115 is in position along the perimeter of the first window pane 108*a*, the tubing 110, 310 may be rolled into place along the perimeter P of the window 100. In embodiments, the tubing 110 is rolled into place such that the tabs 111 (if any) are in the correct position as described above. In other embodiments, the pedestal 315 is inserted into the spacer 115 and the tubing 310 is slid into position. Finally, the second window pane 108*b* may be aligned with the first window pane 108*a* and placed into position.

As described above, the tabs 111 may extend partially along the width of the spacer 115. The adhesive on the spacer 115 interacts with the tabs 111 to keep the tubing 110 in the desired position. The area of the spacer 115 around the tabs 111 adhere to the second window pane 108*b*, as is typical, in order to seal the window panes 108*a* and 108*b* together. It is imperative that the seal between the window panes 108*a* and 108*b* is not impaired by the tabs 111. Accordingly, those of ordinary skill in the art shall recognize that the tabs 111 may have a very thin profile such that they do not excessively interfere with the ability of the adhesively-coated spacer 115 to seal the window panes 108*a* and 108*b* together.

As the tubing 110, 310 is placed along the perimeter P of the window 100, the worker may cut the tubing 110, 310 at positions corresponding to the corners of the window 100 (for example) so that the tubing 110, 310 fits snugly into the corners of the window 100.

Figure 5:
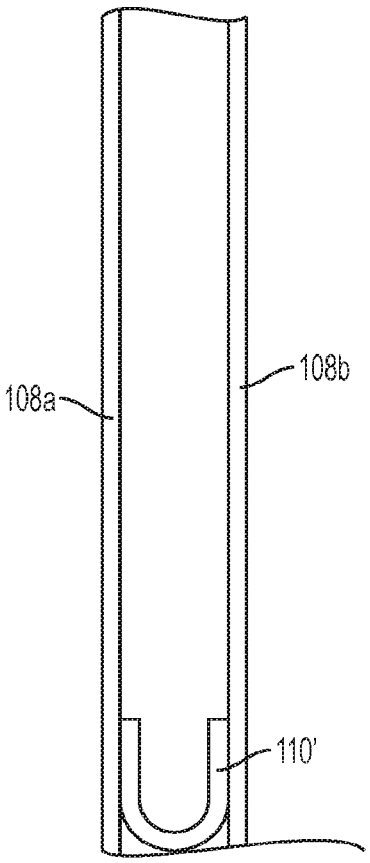
FIG. 5 is a side view of a section of a window according to another embodiment of the invention.
Figure 6:
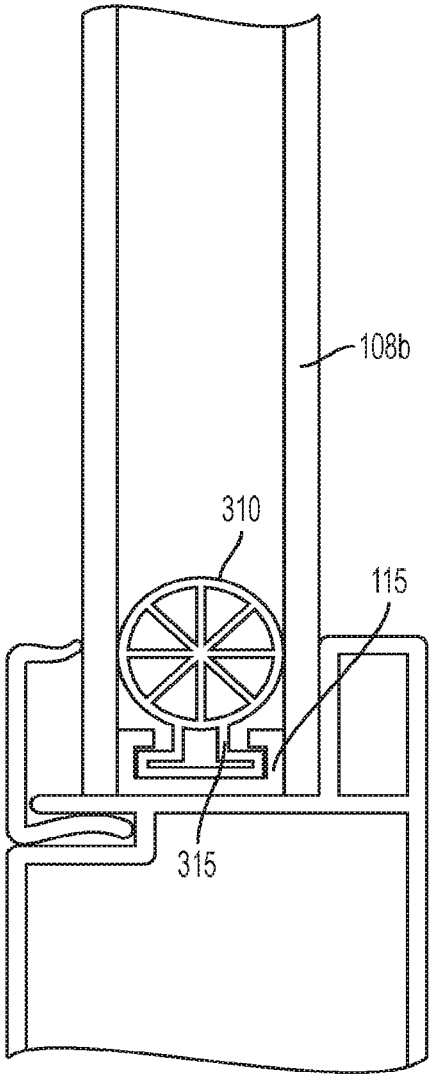
FIG. 6 is a side view of a section of a window according to yet another embodiment of the invention.

When the tubing 110, 310 is placed in position around the perimeter P of the window 100, forces that act upon the window 100 (such as rocks, heavy wind, flying debris, sound, etc.) are mitigated and may prevent the window 100 from cracking or breaking. FIGS. 2, 5, and 6 illustrate front views of various embodiments of the tubing 110 and 310 situated between two window panes 108*a* and 108*b*. In the figures, it can be seen that the tubing 110 110', and 310 is slightly squished between the window panes 108*a* and 108*b* to ensure that the tubing 110, 110', and 310 is in constant contact with the window panes 108*a* and 108*b*. With the tubing 110, 110', and 310 in constant contact with the window panes 108*a* and 108*b*, when a force happens upon one of the window panes 108*a* or 108*b*, the glass transfers a portion of the force to the tubing 110, 110', and 310, which may cause the tubing 110, 110', and 310 to be further squeezed between the window panes 108*a* and 108*b*. The tubing 110, 110', and 310 may then return to its original form (e.g., before the force), thus returning some of the force to the window pane 108. Due to unavoidable losses, the force that is returned to the window pane 108 is less than the force that was initially received thereupon. The tubing 110, 110', and 310 thus takes some of the force that is received by the window pane and may prevent the window 100 from cracking and/or breaking, as the window panes 108 may be better able to withstand the lesser return forces from the tubing 110, 110', and 310.

Similarly, the tubing 110, 110', and 310 may dissipate vibrations caused as a result of sound impacting the window panes 108. As described above, the filaments 120 or splines 312 may be configured in a variety of lengths and/or durometers. When energy waves of varying frequencies hit the window pane(s) 108, the filaments 120 or splines 312 may absorb some of the wave, thereby reducing the noise traveling through the window 100. It shall be understood that absorption of the waveform energy may attenuate several frequencies simultaneously. Additionally, the fundamental frequency of the waveform, as well as other harmonic frequencies contained in the composite set of energy waves, may be attenuated based on the material attributes, temperature, and density of the materials used. The reduction of frequency subsets within the overall frequency spectrum may help to dampen the overall noise profile travelling through the window 100.

It shall be recognized that while the description herein is focused on the use of a double-pane window system 100 for a building, the window system described herein may be used in other applications, including but not limited to car windshields, etc.

Figure 7A:
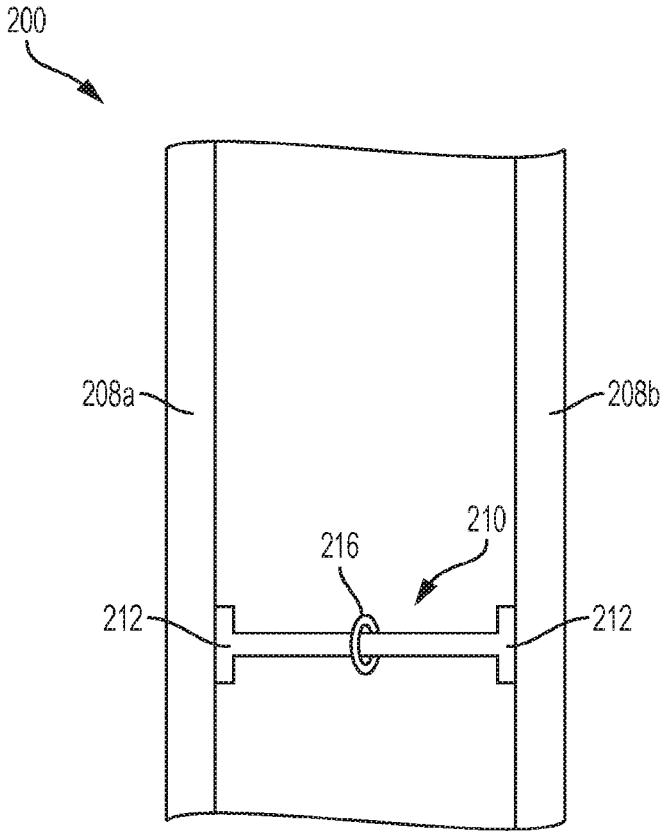
FIG. 7A is a side view of a section of a window according to still yet another embodiment of the invention.
Figure 7B:
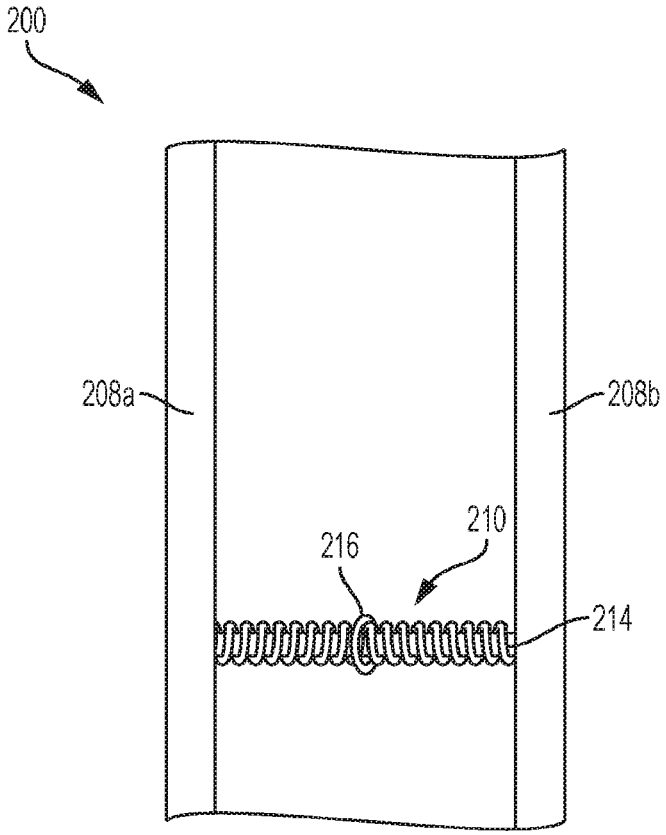
FIG. 7B is a side view of a window according to a further embodiment of the invention.

FIGS. 7A-7B show alternative embodiments of the invention. In FIGS. 7A and 7B, the window system 200 includes two window panes 208*a* and 208*b* separated by a spacer 210. The spacer 210 may be made of a flexible and/or resilient material, such as a urethane, for example. The spacer 210 may be equipped with polarized magnets 212 (FIG. 7A) on either end of the spacer 210. Alternatively, springs 214 (or other biasing apparatus) may be provided on either end of the spacer 210 (FIG. 7B). A weight 216 may be positioned between the magnets 212 (or the springs 214 or other biasing apparatus, as the case may be). For example, the polarizing magnets 212 may suspend the weight 216 along the length of the spacer 210, such that the weight 216 can translate along the length of the spacer 210 when a force is imparted upon one or more of the window panes 208. Alternately, the springs 214 may bias the weight 216 toward the center of the spacer 210.

When a force happens upon the window pane(s) 208, a portion of the force is transferred to the biasing apparatus (e.g., magnets 212, springs 214, etc.), causing the weight 216 to shift from its initial position. The weight 216 subsequently returns to its initial position, thereby imparting a second force on the window pane(s) via the biasing apparatus, which is less than or equal to the force that was initially received upon the window pane(s) 208 in the first place. The window panes 208 may thus be less likely to break or crack due to the force that happens upon the panes 208, in the event of a physical force received by the window. Further, other forces of smaller magnitude may be dissipated.

The window systems 100, 200, and 300 may additionally be equipped with electronic capabilities. Sensors (e.g., motion), microphones, temperature gauges, cameras, recording devices, lights, etc. (collectively "sensors" 180) may be provided along with (or separate from) the tubing 110 or 310 or spacer construct 210 to allow the window system 100, 200, and 300 to monitor and/or influence activity in or around the window 100 or 200. For example, the sensors located at or near the window 100 or 200 may be programmed to set off an alarm (e.g., auditory, visual (e.g., lights), etc.) if a force exceeding a threshold value is received by one or more of the window panes 108.

Optionally, the camera and/or recording device may record the happenings around the window 100 or 200. The camera and/or recording device may be activated in response to an event (e.g., a force received and recognized by a sensor in communication with the camera and/or recording device). Alternately, the camera and/or recording device may record during a specified and programmable period of time (e.g., while on vacation).

The electronic components may be powered via connection to the low-voltage power system within the home. Alternately, a battery may be provided at or near the window to provide power to the system. The battery may be rechargeable, and in embodiments, may be charged via solar power. In still another alternative, the electronic components themselves may be solar powered, or powered using any other method now known or later developed.

Information from the sensors 180 may be transmitted according to methods known to those of skill in the art (e.g., wirelessly over a network) to a remote computing device, which may store and/or otherwise monitor the information therefrom. In embodiments, the information from one sensor 180 (e.g., a motion sensor) may cause a response by another sensor 180 (e.g., lights). For example, if a motion sensor detects movement at or near a window, it may activate the lights, which may be provided around the frame, between the panes of glass 108*a* and 108*b*, or any other location at or near the window.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention. It will be understood that certain features and subcombinations are of utility and may be employed without reference to other features and subcombinations and are contemplated within the scope of the claims. Various steps in described methods may be undertaken simultaneously or in other orders than specifically provided.

The invention claimed is:

1. A window system for dissipating impact forces happening upon a window, comprising:

first and second window panes separated by a spacer; and tubing positioned between the first and second window panes substantially adjacent the spacer;

wherein:

the tubing includes at least one tab extending outwardly from the tubing;

in a use configuration, the tab extends partially along a width of the spacer and is positioned between the spacer and one of the first and second window panes; and the spacer is coated with an adhesive, the adhesive causing a seal to be formed between the first and second window panes and the tab; and wherein:

the tubing further comprises a plurality of filaments of varying lengths disposed along an inside edge of the tubing;

in use, a portion of an initial force happening upon one of the first and second window panes is shifted to the tubing causing the tubing to temporarily deform, the tubing subsequently returning to the tubing's initial shape.

2. The system of claim 1, wherein the tubing has a "U" configuration.

3. The system of claim 1, wherein the tubing is manufactured from a sound-absorbing plastic.

4. A window system for dissipating impact forces happening upon a window, comprising:

first and second window panes separated by a spacer; and tubing positioned between the first and second window panes substantially adjacent the spacer;

wherein:

the tubing includes at least one tab extending outwardly from the tubing;

in a use configuration, the tab extends partially along a width of the spacer and is positioned between the spacer and one of the first and second window panes; and the spacer is coated with an adhesive, the adhesive causing a seal to be formed between the first and second window panes and the tab; and the tubing is configured as a cylinder having a plurality of splines extending radially from a center of the tubing;

in use, a portion of an initial force happening upon one of the first and second window panes is shifted to the tubing causing the tubing to temporarily deform, the tubing subsequently returning to the tubing's initial shape.

5. The system of claim 4, wherein the splines are provided as an insert, the insert being removable from the tubing.

6. The system of claim 4, wherein the tubing is manufactured from a sound-absorbing plastic.

7. A window system for dissipating impact forces happening upon a window, comprising:

first and second window panes separated by a spacer; and tubing positioned between the first and second window panes substantially adjacent the spacer; and a motion sensor;

wherein:

the tubing includes at least one tab extending outwardly from the tubing;

in a use configuration, the tab extends partially along a width of the spacer and is positioned between the spacer and one of the first and second window panes; and the spacer is coated with an adhesive, the adhesive causing a seal to be formed between the first and second window panes and the tab;

in use, a portion of an initial force happening upon one of the first and second window panes is shifted to the tubing causing the tubing to temporarily deform, the tubing subsequently returning to the tubing's initial shape; and the motion sensor is configured to activate a light disposed at the window frame.

8. The system of claim 7, wherein the tubing is manufactured from a sound-absorbing plastic.

9. A window system for dissipating impact forces happening upon a window, comprising:

a first window pane spatially separated from a second window pane;

tubing positioned between the first and second window panes; and a sensor;

wherein:

in use, a waveform energy having a fundamental frequency is received by one of the first and second window panes and is partially transferred to the tubing, the tubing attenuating an impact of the energy on the window;

the tubing is U-shaped;

the sensor measures a change in the environment of the window; and the sensor initiates an alarm in response to the change in the environment.

10. The system of claim 9, wherein a plurality of apertures are formed along a length of the tubing.

11. The system of claim 9, wherein at least one tab extends outwardly from the tubing.

12. The system of claim 11, wherein the tab is positioned between a spacer separating the first and second window panes and at least one of the first and second window panes.

13. The system of claim 9, wherein the waveform energy comprises sound waves, and wherein the tubing dampens the sound transferred across the respective window panes.

14. The system of claim 9, wherein the tubing is manufactured from a sound-absorbing plastic.

15. A window system for dissipating impact forces happening upon a window, comprising:

a first window pane spatially separated from a second window pane; and tubing positioned between the first and second window panes;

wherein:

in use, a waveform energy having a fundamental frequency is received by one of the first and second window panes and is partially transferred to the tubing, the tubing attenuating an impact of the energy on the window;

the tubing is U-shaped; and the tubing comprises a plurality of filaments extending from an inside surface thereof.

16. The system of claim 15, wherein the plurality of filaments comprises filaments having varying lengths.

17. The system of claim 15, wherein the tubing is manufactured from a sound-absorbing plastic.

18. A window system for dissipating impact forces happening upon a window, comprising:

a first window pane spatially separated from a second window pane;

tubing positioned between the first and second window panes; and a sensor;

wherein:

the tubing is U-shaped and comprises a plurality of filaments extending from an inside surface thereof;

in use, a portion of an initial force happening upon one of the first and second window panes is shifted to the tubing causing the tubing to temporarily deform, the tubing subsequently returning to the tubing's initial shape; and the sensor measures a change in the environment of the window; and the sensor initiates an alarm in response to the change in the environment.

19. The system of claim 18, wherein the tubing includes at least one tab extending outwardly from the tubing for securing the tubing between the respective window panes.

20. The system of claim 18, wherein the tubing is manufactured from a sound-absorbing plastic.

* * * * *